US006210496B1

(12) United States Patent
Takagi et al.

(10) Patent No.: US 6,210,496 B1
(45) Date of Patent: Apr. 3, 2001

(54) HIGH-STRENGTH HIGH-WORKABILITY COLD ROLLED STEEL SHEET HAVING EXCELLENT IMPACT RESISTANCE

(75) Inventors: Syusaku Takagi, Chiba; Kazuya Miura, Chiyoda-ku; Osamu Furukimi, Chiba; Kei Sakata, Chiba; Takashi Obara, Chiba, all of (JP)

(73) Assignee: Kawasaki Steel Corporation, Kobe (JP)

( * ) Notice: Subject to any disclaimer, the term of this patent is extended or adjusted under 35 U.S.C. 154(b) by 0 days.

(21) Appl. No.: 09/230,888

(22) PCT Filed: Jun. 9, 1998

(86) PCT No.: PCT/JP98/02546

§ 371 Date: Feb. 12, 1999

§ 102(e) Date: Feb. 12, 1999

(87) PCT Pub. No.: WO98/58094

PCT Pub. Date: Dec. 23, 1998

(30) Foreign Application Priority Data

Jun. 16, 1997 (JP) ..... 9-158389

(51) Int. Cl.[7] ..... C22C 38/02; C22C 38/04; C22C 38/06; C22C 38/34; C22C 38/38

(52) U.S. Cl. ..... 148/333; 420/83; 420/84; 420/87; 420/103; 420/104; 420/117; 420/118; 420/126; 148/654

(58) Field of Search ..... 148/333, 654; 420/83, 84, 87, 103, 104, 118, 117, 126

(56) References Cited

U.S. PATENT DOCUMENTS 5,332,453 * 7/1994 Okada et al. ..... 148/320
5,470,403 * 11/1995 Yoshinaga et al. ..... 148/330
5,558,727 * 9/1996 Miura et al. ..... 148/333
5,567,250 * 10/1996 Akamatsu et al. ..... 148/320
5,618,355 * 4/1997 Koyama et al. ..... 148/320
5,634,988 * 6/1997 Kurebayashi et al. ..... 148/320
5,690,755 * 11/1997 Yoshinaga et al. ..... 148/533
5,837,956 * 11/1998 Okabe et al. ..... 219/61

FOREIGN PATENT DOCUMENTS 3-277743 12/1991 (JP) .
4-332524 11/1992 (JP) .
5-195149 8/1993 (JP) .
B2-5-64215 9/1993 (JP) .
9-111396 4/1997 (JP) .

OTHER PUBLICATIONS

Takagi, Shusaku, "High Strain Rate Deformation of High Strength Steels," CAMP–ISIJ, vol. 9 (1996), pp. 1108–1111.

* cited by examiner

*Primary Examiner*—Daniel J. Jenkins
*Assistant Examiner*—Nicole Coy
(74) *Attorney, Agent, or Firm*—Oliff & Berridge, PLC

(57) ABSTRACT

A cold rolled steel sheet having high strength and high formability and having excellent crushing performance can include 0.05–0.40 mass % of C, 1.0–3.0 mass % of Si, 0.6–3.0 mass % of Mn, 0.02–1.5 mass % of Cr, 0.010–0.20 mass % of P and 0.01–0.3 mass % of Al, with the remainder consisting essentially of Fe. The steel sheet includes a ferrite major phase and a minor phase consisting of martensite, acicular ferrite and retained austenite. The cold rolled steel sheet can be used in automobiles.

6 Claims, 6 Drawing Sheets

HIGH-STRENGTH HIGH-WORKABILITY COLD ROLLED STEEL SHEET HAVING EXCELLENT IMPACT RESISTANCE

TECHNICAL FIELD

The present invention relates to cold rolled steel sheet with high strength and high formability having an excellent crushing performance which is suitable for use as a steel sheet for automobiles.

BACKGROUND ART

Under the trend of making automobiles light in weight, there has been an especially brisk demand for thin steel sheet with high strength having an excellent formability.

In addition, safety of automobiles has been thought to be important too and, accordingly, there has been a demand an improvement in crushing performance which is a yardstick for safety upon crash.

With regard to outer and inner panels for automobiles, cold rolled steel sheets are advantageous in terms of homogeneity of surface roughness and phosphatability.

Under such current circumstances, various cold rolled steel sheets with high strength have been developed already.

For example, in the Japanese Examined Patent Publication Hei-05/064215 and Laid-Open Patent Publication Hei-04/333524, there are disclosures on the method for the manufacture of high strength steel having a structure of ferrite containing not less than 3% of bainite and retained austenite (hereinafter, referred to as TRIP steel).

However, although the TRIP steel has a high elongation and a good formability (TS×El≧22000 MPa. %), there is a problem that this steel does not satisfy the current requirement for severe crushing performance.

In addition, there is another problem that the work hardening (WH) at press formability and the bake hardening (BH) at painting and baking thereafter are as low as about 70 MPa.

When those work and bake hardenings (WH+BH) are low, there is a big disadvantage in terms of ensuring the strength after forming, painting and baking.

On the other hand, the so-called dual phase steel (hereinafter, referred to as DP steel) having a dual phase of ferrite and martensite is disclosed, for example, in the Japanese Laid-Open Patent Publication Hei-09/111396 as a high strength steel sheet having an excellent crushing performance.

However, although the DP steel has an excellent crushing performance, its elongation is not sufficient and there is a problem in formability.

As mentioned above, no cold rolled steel sheet which satisfies both requirements of sufficient formability and severe safety standard has been available at present and, therefore, there has been a demand for developing it.

SUMMARY OF THE INVENTION

The present invention advantageously complies with the above requirements and its object is to offer a cold rolled steel sheet with high strength and high formability having an excellent crushing performance where the steel has both excellent formability and crushing performance (to be more specific, its tensile strength/elongation balance [TS×El] is not less than 24000 MPa % and its dynamic n-value is not less than 0.35) and, in addition, it has an excellent work hardening and bake hardening (i.e., WH+BH is not less than 100 MPa).

The term "dynamic n-value" used here has been firstly found by the present inventors as an index for crushing performance and it is now possible by the use of the dynamic n-value to evaluate the crushing performance in more precise manner than before.

Thus, in the past, crashworthiness was considered in relation with strength and it was simply believed that the higher the strength, the higher the crashworthiness. However, it has been found now that strength and crashworthiness are not always in such a simple relationship.

The present inventors have conducted an intensive investigation on this respect and found and clarified that, when automobiles are crashed, strain rate increases up to $2\times10^3$/s and that, when energy upon deformation at such a high rate is to be absorbed by steel sheet as much as possible or, in other words, when crashworthiness is to be improved, it is effective that the n-value upon tension deformation of steel sheet under the condition of strain rate=$2\times10^3$/s (hereinafter, referred to as dynamic n-value) is made high.

Here, the momentary n-value when the elongation is 10% is defined as a dynamic n-value.

In the meanwhile, it has been also found that, when the dynamic n-value is made high, that is effective in improving the strength in the case of dynamic deformation as well.

Now, the history how the present invention has been achieved will be illustrated as hereunder.

Thus, in order to achieve the above-mentioned object, the present inventors have at first studied the relation between structure and characteristics in TRIP steel which is a conventional steel.

As a result, it has been found that, although production of a bainite phase has been believed to be essential for obtaining a sufficient amount of retained austenite which is advantageous for improving the formability, such a bainite phase is a cause for deteriorating the crushing performance.

Therefore, the present inventors suppressed the production of such a bainite phase, especially carbide, or, in other words, changed the minor phase other than the ferrite, (polygonal ferrite) which is a major phase, from the conventional "bainite+retained austenite" to a complex structure of "acicular ferrite+martensite+retained austenite" whereupon an unexpectedly favorable result has been achieved.

The present invention is based upon the above-mentioned finding.

Thus, the present invention relates to a cold rolled steel sheet with high strength and high formability having an excellent crushing performance which is characterized in having ferrite as a major phase and having a minor phase consisting of martensite, acicular ferrite and retained austenite.

In the present invention, it is preferred that the ratio of the minor phase in the steel structure is 3–40%. Further, it is preferred that the ratios of martensite, retained austenite and acicular ferrite in the minor phase are 10–80%, 8–30% and 5–60%, respectively.

More preferably, the steel sheet contains 0.05–0.40 mass % of C; 1.0–3.0 mass % of Si;

0.6–3.0 mass % of Mn; 0.02–1.5 mass % of Cr;

0.010–0.20 mass % of P; and 0.01–0.3 mass % of Al and, if necessary, it may contain at least one component which is selected from:

0.005–0.25 mass % of Ti and 0.003–0.1 mass % of Nb as component(s) for improving the strength and may further contain at least one component which is selected from:

not more than 0.1 mass % of Ca and not more than 0.1 mass % of Rem as component(s) for improving the formability.

DETAILED DESCRIPTION OF PREFERRED EMBODIMENTS

The present invention will be specifically illustrated as hereunder.

Figure 1:
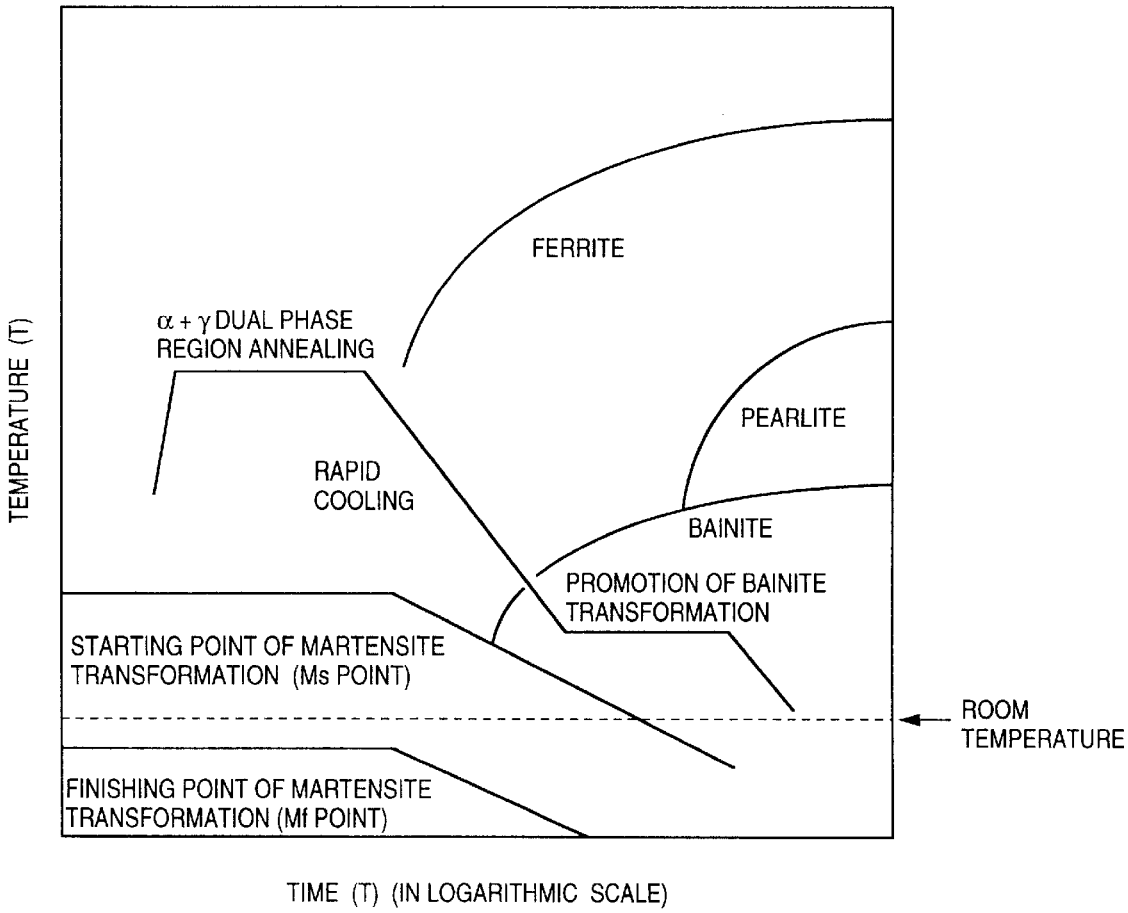
FIG. 1 is a representative continuous cooling transformation diagram (CCT diagram) of the conventional TRIP steel.

A representative continuous cooling transformation diagram (CCT diagram) of the conventional TRIP steel is shown in FIG. 1.

As shown in FIG. 1, in the conventional TRIP steel, it is heated in a dual phase regions of $\alpha$ and $\gamma$ during a continuous annealing, then subjected to a rapid cooling down to near 400° C. to give rise to a bainite transformation region, retained at this temperature range for several minutes whereby bainite transformation is resulted and, at the same time, solute carbon is concentrated in a untransformed austenite to stabilize, and cooled down to room temperature so that not less than several % of austenite is retained there.

However, although the TRIP steel manufactured as such has excellent strength and formability, no sufficient crushing performance is achieved as mentioned already.

In view of the above, the present inventors have conducted a lot of experiments and investigations for avoiding the bainite transformation and, as a result, they have found the following facts.

(1) When small amounts of Cr are added as a component for the steel, a nose in the bainite transformation region in the above-mentioned CCT diagram comes back to the long time side whereupon the formation of bainite (particularly, the precipitation of carbide) is suppressed and, in place thereof, acicular ferrite is separated out.

(2) In a continuous annealing process of cold rolled steel sheets, separation into predetermined amounts of ferrite and austenite is conducted by retaining a temperature range of a dual phase region. Accordingly, there is no need of producing the ferrite during the cooling stage and that is a big difference from the hot rolling process. In that case however, the start point of pearlite transformation moves to the short time side when Cr is solely added thereto and, accordingly, pearlite comes into the minor phase. When pearlite contaminates as such, a very satisfactory result is not achieved even if production of bainite is suppressed.

(3) However, when small amounts of P are added together with Cr, such a pearlite transformation is suppressed whereby a complex structure consisting of acicular ferrite, retained austenite and martensite is formed as the minor phase.

(4) The minor phase formed as such, which consists of acicular ferrite, retained austenite and martensite, significantly improves the crushing performance without deteriorating the formability.

Figure 2:
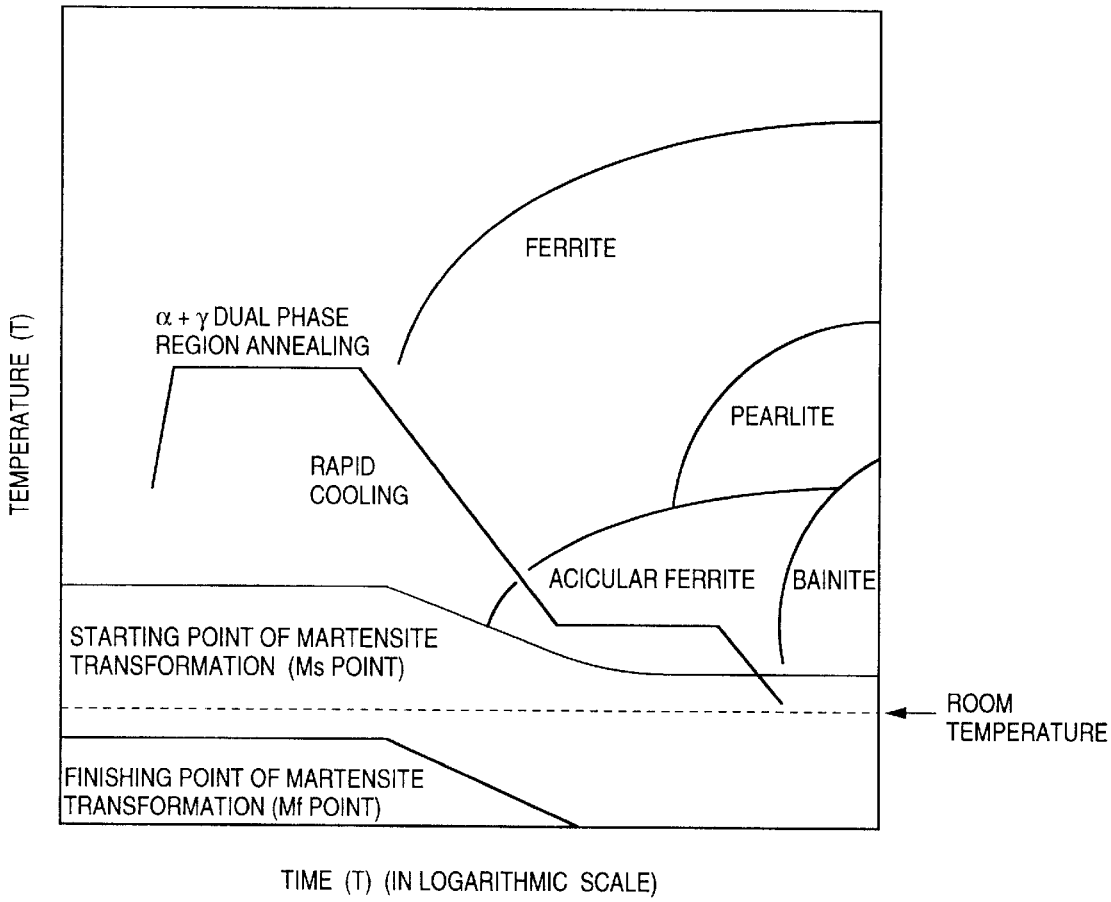
FIG. 2 is a representative continuous cooling transformation diagram (CCT diagram) of the component system of the present invention.

A representative CCT diagram in the component system of the present invention is shown in FIG. 2.

As shown in the diagram, when small amounts of Cr and P are added, the nose of the bainite transformation region decreases while an acicular ferrite region significantly appears. Therefore, when such an acicular ferrite region is retained for a short while and a rapid cooling is conducted after that, it is now possible to make the minor phase in a complex structure consisting of acicular ferrite, retained austenite and martensite and to give a cold rolled steel sheet having both excellent formability and crushing performance.

The acicular ferrite used here means that where a long diameter of the grain is about 10$\mu$m or shorter, an aspect ratio is 1:1.5 or more and an amount of precipitated cementite is 5% or less.

Incidentally, precipitation of a large amount (10% or more) of cementite is noted in bainite of the conventional TRIP steel and, therefore, the acicular ferrite of the present invention is clearly distinguished from bainite of the TRIP steel.

Figure 3:
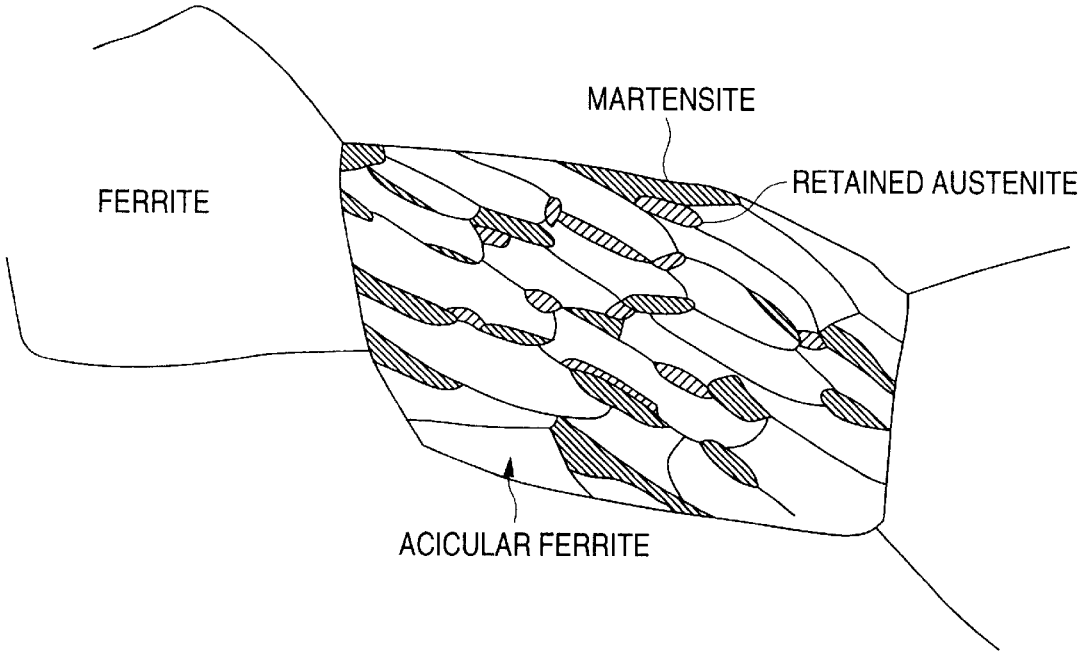
FIG. 3(*a*) shows a characteristic phase structure of the minor phase obtained by the present invention while FIG. 3(*b*) shows a phase structure of the minor phase in the conventional TRIP steel.
Figure 3:
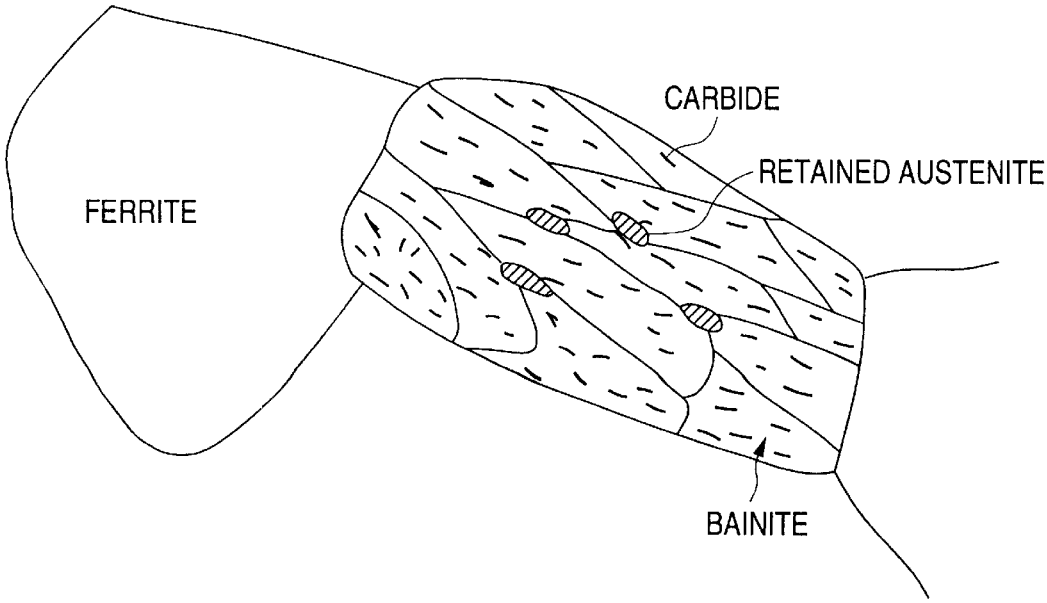

The phase structure which is characteristic to the minor phase obtained by the present invention is shown in FIG. 3(*a*) while the phase structure of the minor phase in the conventional TRIP steel is shown in FIG. 3(*b*) both in the centers of the drawings. Around the minor phase, there is ferrite which is a major phase.

The minor phase of the conventional TRIP steel has a phase structure in which retained austenite is scattered in bainite while, in the minor phase of the present invention, acicular ferrite and martensite are arranged in layers and retained austenite are scattered on their interface (at the side of martensite).

Thus, one of the characteristic features of the present invention is that acicular ferrite is precipitated in the minor phase as such and it is believed that such an acicular ferrite phase increases the TS×El and also increases the dynamic n-value. In addition, when appropriate amounts of martensite and acicular ferrite are arranged in layers, (WH+BH) of as big as 100 MPa or even more can be achieved although the reasons are ambiguous.

Incidentally, according to the knowledge of the present inventors, it has been confirmed that when the interfacial area rate between acicular ferrite and martensite becomes high, there is a tendency that the dynamic n-value becomes big.

In the present invention, it is preferred that the ratio of the above-mentioned minor phase in the steel structure is 3–40%.

The reason is that, when the ratio of the phase is less than 3%, a sufficient crushing performance is not achieved while, when it is more than 40%, elongation and, as a result thereof, tensile strength/elongation balance become low. A more preferred ratio is 10–30%.

Incidentally, in the present invention, a steel sample is polished and subjected to an etching with a solution of 2% nitric acid and ethyl alcohol and the phase ratio is calculated by means of an image analysis system of its photomicrograph.

With regard to the ratio of each of the phases in the minor phase, it is preferred that martensite is made 10–80% (more preferably, 30–60%), retained austenite is made 8–30% (more preferably, 10–20%) and acicular ferrite is made 5–60% (more preferably, 20–50%).

The reasons are as follows. Thus, when the ratio of martensite is less than 10%, a sufficient crushing performance is not achieved while, when it is more than 80%, elongation and, as a result, tensile strength/elongation balance become low.

When the ratio of retained austenite is less than 8%, a sufficient elongation is not achieved while, when it is more than 30%, crushing performance lowers.

Further, when the ratio of acicular ferrite is less than 5%, good crushing performance is not achieved while, when it is more than 60%, elongation lowers.

With regard to the ratio of each of the phases in the whole steel structure, it is suitable that martensite and acicular ferrite is made 5–15% each and that retained austenite is made about 2–10%.

In the meanwhile, in the present invention, the steel structure is not always composed of a major phase (consisting of ferrite) and a minor phase (a mixed phase consisting of martensite, acicular ferrite and retained austenite) but a bainite phase or the like may be separated to some extent. However, even when such a third phase is contaminated therein, there is no problem at all in the characteristics of the product provided that its ratio is 10% or less of the minor phase.

Now, the reason why the components and their amounts in the steel sheet are limited as mentioned above will be explained as hereunder.

C: 0.05–0.40 mass %

C is a useful element which not only effectively contributes in making the steel strong but also gives a retained austenite. However, when the amount is less than 0.05 mass %, the effect is poor while, when it is more than 0.40 mass %, ductility lowers. Accordingly, the amount of C is limited to a range of 0.05–0.40 mass %.

Si: 1.0–3.0 mass %

Si is an essential element for production of retained austenite and, for such a purpose, it must be added at least in an amount of 1.0 mass %. However, addition of more than 3.0 mass % causes not only a decrease in ductility but also a decrease in scale property resulting in a problem of surface quality. Accordingly, the amount of Si is limited to a range of 1.0–3.0 mass %.

Mn: 0.6–3.0 mass %

Mn is an element which is useful not only for strengthening but also for giving a retained austenite. However, when the amount is less than 0.6 mass %, the effect is poor while, when it is more than 3.0 mass %, a decrease in ductility is resulted. Accordingly, the amount of Mn is limited to a range of 0.6–3.0 mass %.

Cr: 0.02–1.5 mass %

Addition of Cr characterizes the present invention and, as a result of addition of Cr, the minor phase gives acicular ferrite as mentioned above. For such a purpose, addition of at least 0.02 mass % of Cr is necessary but, when more than 1.5 mass % is added, coarse and big Cr carbide is produced and, at the same time, production of pearlite proceeds whereby ductility is deteriorated and, moreover, each of tensile strength/elongation balance, dynamic n-value and (WH+BH) become low. Accordingly, the amount of Cr is limited to a range of 0.02–1.5 mass %. Preferably, it is 0.1–0.7 mass %.

P: 0.010–0.20 mass

P is a useful element for not only effectively contributing to improve the strength by dissolving in ferrite, but also suppressing the pearlite transformation, which is a cause of deterioration of ductility upon addition of Cr solely, improving a tensile strength/elongation balance by making the minor phase in the structure mainly comprising martensite, acicular ferrite and retained austenite, and improving the dynamic n-value and (WH+BH) as well.

In order to achieve the above-mentioned effect, addition of at least 0.010 mass % is necessary but, when the amount of as much as more than 0.20 mass % is added, weldability is deteriorated. Accordingly, the amount of P is limited to a range of 0.010–0.20 mass %. A preferred range is 0.02–0.10 mass %.

Figure 4:
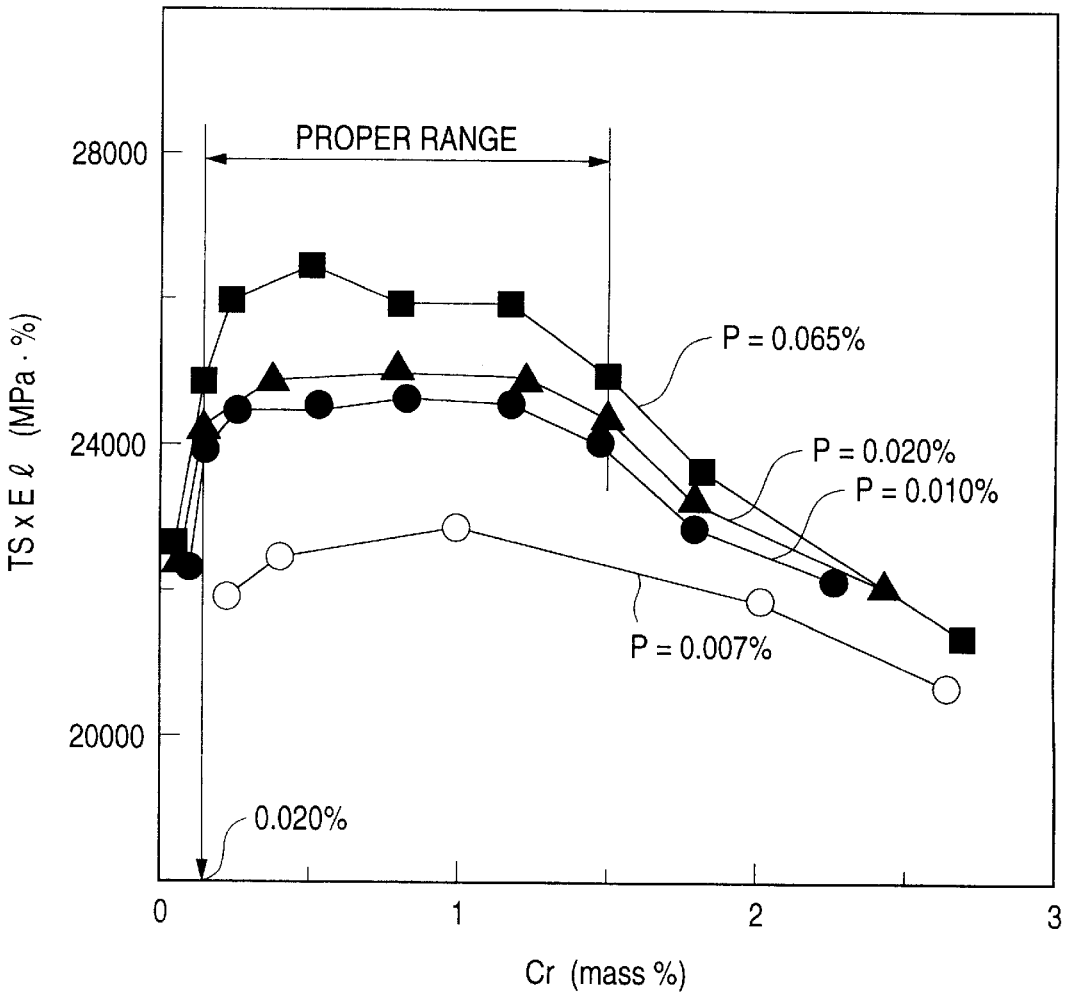
FIG. 4 is a graph showing the relation between the amount of Cr and the tensile strength/elongation balance taking the P-value as a parameter.
Figure 5:
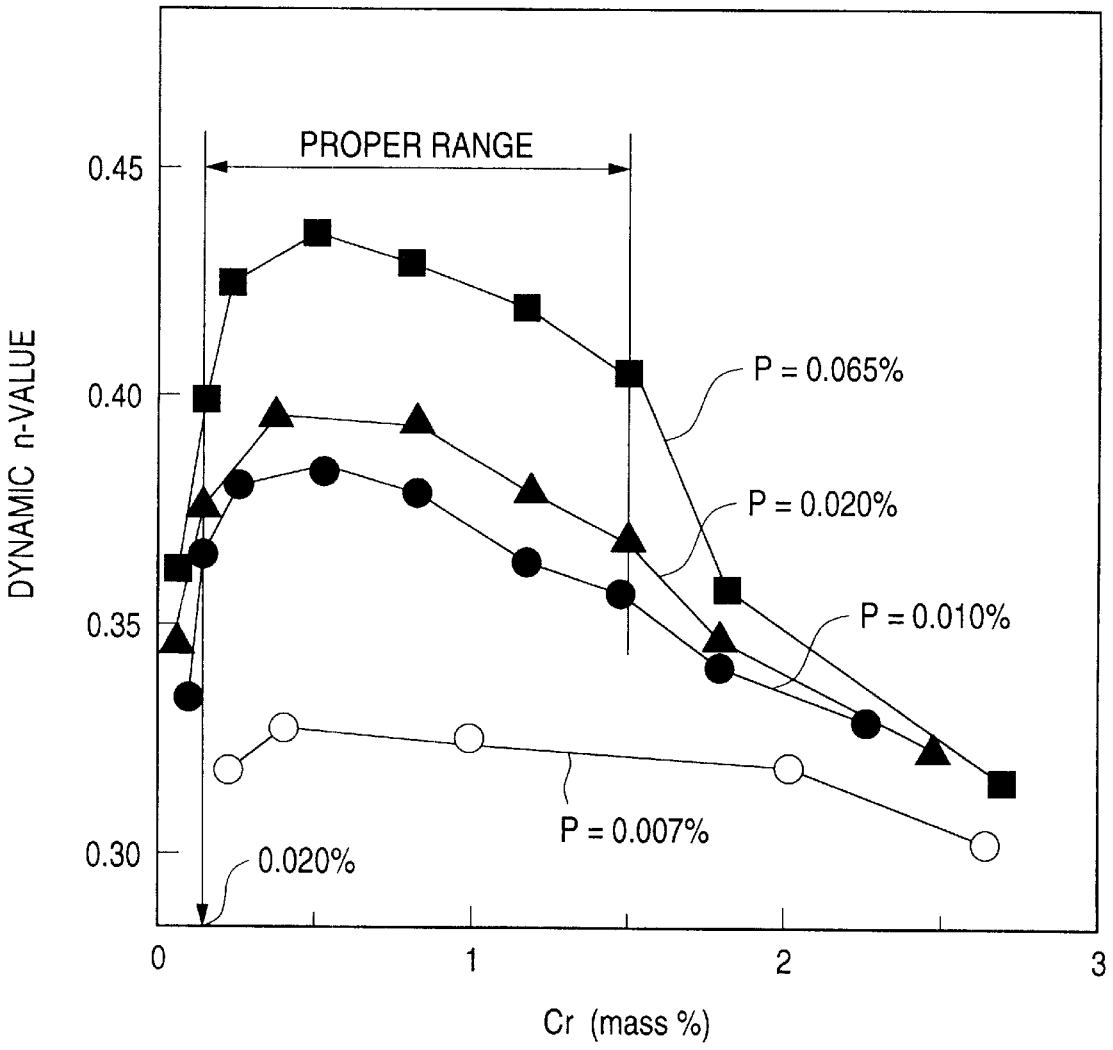
FIG. 5 is a graph showing the relation between the amount of Cr and the dynamic n-value taking the P-value as a parameter.

FIG. 4 and FIG. 5 show the result on the investigation for the relation of the amount of Cr with the tensile strength/elongation balance and also with the dynamic n-value taking the amount of P as a parameter.

It is apparent from FIGS. 4 and 5 that, within such ranges that the amount of Cr is 0.02–1.5 mass % and that the amount of P is not less than 0.010 mass %, the requirements of TS×El≧24000 (MPa. %) and of dynamic n-value≧0.35 are satisfied achieving excellent formability and crushing performance.

Especially when the amount of P is 0.020 mass % or more, far better characteristic value is obtained where the dynamic n-value is 0.37 or more.

Al: 0.01–0.3 mass %

Al effectively contributes as a deoxidizer and, for such a purpose, the content of at least 0.01 mass % is necessary while, even when it is added in an amount of more than 0.3 mass %, the effect is saturated and, rather, the disadvantage in terms of cost is significant. Accordingly, the amount of Al is limited to a range of 0.01–0.3 mass %.

Basic components are mentioned as hereinabove and, besides them, Ti and Nb may be added as components for improving the strength, and Ca and Rem may be added as components for improving formability within a range as mentioned below.

Ti: 0.005–0.25 mass %; Nb: 0.003–0.1 mass %

Both Ti and Nb effectively contribute to improvement in strength and, therefore, they may be added if necessary. However, when the amount is too little, the effect by addition is poor while, when it is too much, a decrease in ductility is resulted. Accordingly, it is preferred to add them within the above-mentioned range.

Ti and Nb are also useful in preventing intergranular cracking at the edge which is apt to occur upon hot rolling of medium carbon steel of the kind of the present invention.

Ca: 0.1 mass % or less; Rem: 0.1 mass % or less

Ca and Rem effectively control the shape of oxides and sulfides and effectively contribute to improvement in formability, particularly in stretch flanging formability. However, when each of the amounts is more than 0.1 mass %, the effect is saturated and, moreover, cracking is apt to take place during hot rolling. Accordingly, it is preferred that each of them is added in an amount of 0.1 mass % or less.

Incidentally, it is preferred that each of Ca and Rem is added in an amount of 0.0003 mass % or more for steadily achieving the above-mentioned effect.

Now the method for the manufacture of the steel of the present invention will be mentioned. To sum up, a complex structure consisting of martensite, acicular ferrite and retained austenite is to be formed in the steel of the present invention as the minor phase and, therefore, cooling is to be conducted along a cooling curve as shown in FIG. 2.

Thus, the hot rolled sheet obtained by means of a hot rolling by a usual method is descaled by means of pickling or the like, and then subjected to a cold rolling with a pressure reduction rate of not less than 30% or, preferably, 50–80% to give a cold rolled sheet.

Then the resulting cold rolled sheet is heated by a continuous annealing to a dual phase region of ferrite and austenite at about 740–820° C., retained at that temperature or gradually cooled at the rate of not higher than 10° C./second, then cooled from 600° C. or higher to the acicular ferrite region of 350–450° C. at the rate of 20–60° C./second and kept at that temperature (or cooled gradually) for 0.5–5 minutes. After that, it is cooled down to room temperature at the rate of not higher than 50° C./second to form the minor phase consisting of acicular ferrite, martensite and retained austenite.

Among the above-mentioned manufacturing steps, the characteristic feature as a cycle for continuous annealing is that a desired effect can be achieved by a relatively slow rate for cooling down to 350–450° C. as compared with the cooling rate disclosed in the prior art such as the above-mentioned Japanese Examined Patent Publication Hei-05/064215 and Laid-Open Patent Publication Hei-04/333524. Thus, in the prior art, cooling is conducted at the rate of 50° C./second or higher in the former publication and at the rate of around 10–200° C./second in the latter problem for forming the minor phase mainly comprising bainite and retained austenite.

In accordance with the present invention however, the cooling rate is made as slow as 60° C./second or lower to give a desired structure. Thus, as a cooling means, there is no need of applying a mist cooling or a water cooling, which requires a high cost, but cooling by gas jet or roll is sufficient. Accordingly, the present invention is advantageous in terms of not only the cost but also the surface property.

With regard to the retention time at the acicular ferrite region at 350–450° C., it is essential to make its upper limit six minutes. This is because if the retention time at the acicular ferrite is too long, bainite is produced whereby the minor phase which is a desired structure is not achieved.

Incidentally, in the above-mentioned prior art publication, the upper limits for the retention time are mentioned as 10 minutes and 20 minutes, respectively. Accordingly, it is quite apparent that the structure of the minor phase of the present invention is entirely different from that in the prior art.

EXAMPLES

Steel slabs of various compositions as shown in Table 1 were heated at 1200° C., then subjected to a finishing hot-rolling at 860° C. and coiled at 580° C. to give a hot rolled steel sheet having a thickness of 3.2 mm.

Then, after the sheet was subjected to a pickling, it was subjected to a cold rolling to an extent of 1.2 mm.

After that, it was heated up to 800° C. at the rate of 10 ° C./second using a continuous annealing furnace, retained at that temperature for 40 seconds, gradually cooled down to 635° C. at the rate of 4° C./second, then cooled down to an acicular ferrite region of 410° C. at the rate of 43° C./second, retained at that temperature for 180 seconds, and cooled down to room temperature at the rate of 10° C./second. After that, a temper rolling of 1.0% was conducted.

Tensile test pieces were cut out from the resulting cold rolled sheet and each of the test pieces was subjected to a tensile test under the condition where a strain rate was $2\times10^{-2}$/s to determine yield strength (YS), tensile strength (TS) and elongation (El).

In addition, a material for a Hopkinson bar impact tensile test (*Zairyo to Purosesu*, vol. 9, (1996), pages 1108–1111) was used and subjected to a tension test under the condition where a strain rate was $2\times10^{3}$/s whereupon the momentary n-value (dynamic n-value) when the elongation was 10% was determined.

Further, a hole expansion test was conducted using a conical punch having a top angle of 60° under the conditions with a guide hole, which is 10 mm diameter, pierced by 12.5% of clearance. Stretch flanging formability (λ) was calculated according to the following formula.

$$\lambda=[(d_1-d_0)/d_0]\times100$$

In the formula, $d_0$ is diameter of a guide hole; and $d_1$ is diameter of a hole when cracks passing through the sheet are formed around the hole upon expansion of the hole.

Figure 6:
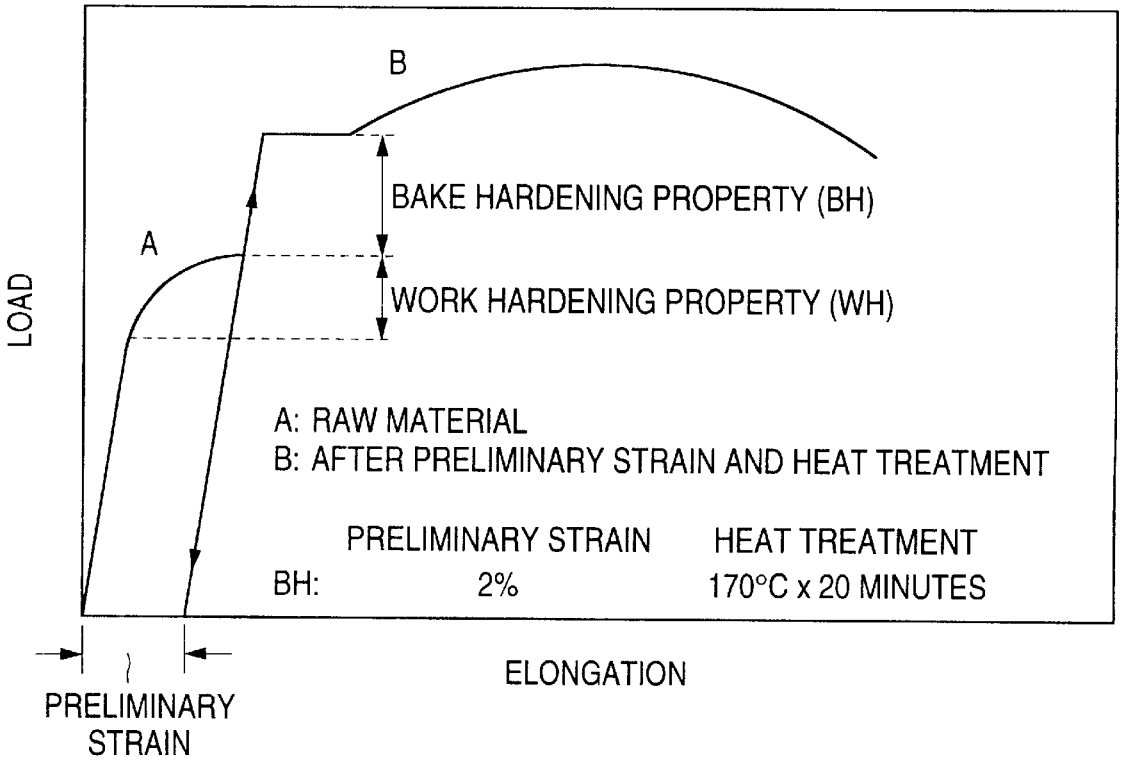
FIG. 6 is an illustrative drawing for work hardening property (WH) and bake hardening property (BH).

Furthermore, the amount of work hardening (WH) upon press molding and the amount of bake hardening (BH) upon painting/baking (170° C.) thereafter were measured as well. Incidentally, WH and BH were determined from FIG. 6 using a tensile tester having a strain rate of $2\times10^{-2}$/s.

Steel structure, TS×El balance, dynamic n-value, stretch flanging formability and WH+BH were tested for each of the cold rolled steel sheets and the results are shown in Table 2 and Table 3.

It is apparent from Tables 2 and 3 that all of the products where a complex structure of martensite, acicular ferrite and retained austenite was formed as the minor phase in accordance with the present invention showed excellent tensile strength/elongation balance and crushing performance, which were as good as TS×El≧24000 MPa. % and dynamic n-value ≧0.35, respectively, and, in addition, they further showed a good work and bake hardenings of WH+BH≧100 MPa as well.

When Ca and Rem were further added, it is also possible to improve the stretch flanging formability.

When a major phase is ferrite and a minor phase is a complex structure consisting of martensite, acicular ferrite and retained austenite in accordance with the present invention, it is now possible to afford a cold rolled steel sheet which shows both excellent formability and crushing performance.

As a result thereof, under the current status where weight reduction of automobiles has been aimed at and safety of automobiles has been also seriously considered, it is possible to produce cold rolled steel sheet having an excellent crushing performance which has been receiving public attention in recent years as a yardstick for safety upon crash.

TABLE 1

(mass %)

| Steel No. | C | Si | Mn | Cr | P | Al | Ti | Nb | Others | Remarks |
|---|---|---|---|---|---|---|---|---|---|---|
| 1 | 0.11 | 1.23 | 1.35 | 0.13 | 0.031 | 0.034 | — | — | — | Examples of the Invention |
| 2 | 0.15 | 1.71 | 1.18 | 0.21 | 0.071 | 0.028 | — | — | — | " |
| 3 | 0.21 | 1.05 | 2.02 | 0.33 | 0.041 | 0.051 | — | — | — | " |
| 4 | 0.10 | 1.21 | 0.71 | 0.58 | 0.031 | 0.033 | — | — | — | " |
| 5 | 0.13 | 1.02 | 1.51 | 0.23 | 0.027 | 0.022 | — | — | — | " |
| 6 | 0.12 | 1.39 | 1.87 | 0.03 | 0.029 | 0.070 | — | — | — | " |
| 7 | 0.24 | 1.41 | 1.02 | 1.17 | 0.015 | 0.052 | — | — | — | " |
| 8 | 0.08 | 1.29 | 1.18 | 0.25 | 0.181 | 0.041 | — | — | — | " |
| 9 | 0.11 | 1.25 | 1.50 | 0.12 | 0.049 | 0.035 | 0.008 | — | — | " |
| 10 | 0.14 | 1.24 | 0.80 | 0.12 | 0.048 | 0.039 | 0.021 | — | — | " |
| 11 | 0.15 | 2.18 | 1.99 | 0.19 | 0.049 | 0.029 | 0.051 | — | — | " |
| 12 | 0.16 | 2.31 | 2.31 | 0.12 | 0.059 | 0.035 | — | 0.007 | — | " |
| 13 | 0.18 | 1.24 | 0.85 | 0.12 | 0.049 | 0.069 | — | 0.029 | — | " |
| 14 | 0.11 | 1.22 | 1.57 | 0.12 | 0.049 | 0.035 | — | 0.230 | — | " |
| 15 | 0.12 | 1.39 | 1.81 | 0.51 | 0.027 | 0.081 | 0.024 | 0.017 | — | " |
| 16 | 0.12 | 1.31 | 1.43 | 0.25 | 0.041 | 0.051 | — | — | Ca: 0.0013 | " |
| 17 | 0.15 | 1.13 | 1.27 | 0.33 | 0.059 | 0.029 | 0.026 | — | Rem: 0.009 | " |
| 18 | 0.04 | 1.21 | 1.51 | 0.19 | 0.044 | 0.035 | — | — | — | Examples for Comparison |
| 19 | 0.43 | 1.21 | 1.61 | 0.18 | 0.051 | 0.035 | — | — | — | " |
| 20 | 0.12 | 0.92 | 1.29 | 0.17 | 0.080 | 0.039 | — | — | — | " |
| 21 | 0.11 | 3.30 | 1.33 | 0.24 | 0.099 | 0.035 | — | — | — | " |
| 22 | 0.09 | 1.22 | 0.55 | 0.39 | 0.021 | 0.041 | — | — | — | " |
| 23 | 0.14 | 1.39 | 3.10 | 0.38 | 0.120 | 0.029 | — | — | — | " |
| 24 | 0.17 | 1.49 | 1.39 | 0.01 | 0.056 | 0.033 | — | — | — | " |
| 25 | 0.16 | 1.51 | 1.39 | 1.67 | 0.061 | 0.029 | — | — | — | " |
| 26 | 0.11 | 1.22 | 1.28 | 0.39 | 0.008 | 0.027 | — | — | — | " |
| 27 | 0.10 | 1.29 | 1.20 | 0.21 | 0.240 | 0.069 | — | — | — | " |
| 28 | 0.10 | 1.33 | 1.20 | 0.18 | 0.043 | 0.40 | — | — | — | " |

TABLE 2

| Steel No. | Structure of the Minor Phase | Ratio of the Minor Phase | Ratios of Components of the Minor Phase (%) M | AF | γ | P | Remarks |
|---|---|---|---|---|---|---|---|
| 1 | M + AF + γ | 16 | 72 | 16 | 12 | 0 | Examples of the Inventon |
| 2 | " | 15 | 48 | 31 | 21 | 0 | " |
| 3 | " | 24 | 61 | 9 | 30 | 0 | " |
| 4 | " | 22 | 34 | 42 | 24 | 0 | " |
| 5 | " | 28 | 46 | 37 | 17 | 0 | " |
| 6 | " | 16 | 45 | 46 | 9 | 0 | " |
| 7 | " | 14 | 40 | 45 | 15 | 0 | " |
| 8 | " | 20 | 41 | 32 | 27 | 0 | " |
| 9 | " | 22 | 31 | 55 | 14 | 0 | " |
| 10 | " | 26 | 35 | 45 | 20 | 0 | " |
| 11 | " | 24 | 52 | 21 | 27 | 0 | " |
| 12 | " | 27 | 19 | 58 | 23 | 0 | " |
| 13 | " | 19 | 17 | 54 | 29 | 0 | " |
| 14 | " | 19 | 29 | 46 | 25 | 0 | " |
| 15 | " | 16 | 58 | 15 | 27 | 0 | " |
| 16 | " | 17 | 61 | 9 | 30 | 0 | " |
| 17 | " | 18 | 45 | 35 | 20 | 0 | " |
| 18 | M + AF + B + P | 11 | 13 | 35 | 0 | 2 | Examples for Comparison0 |
| 19 | M + AF + γ + B | 13 | 51 | 2 | 3 | 0 | " |
| 20 | M + AF + B | 16 | 34 | 21 | 0 | 0 | " |
| 21 | M + B | 8 | 41 | 0 | 0 | 0 | " |
| 22 | B | 18 | 0 | 0 | 0 | 0 | " |
| 23 | M + B + P | 24 | 35 | 0 | 0 | 5 | " |
| 24 | B + γ | 19 | 0 | 0 | 10 | 0 | " |
| 25 | M + P | 27 | 98 | 0 | 0 | 2 | " |
| 28 | M + AF + P | 27 | 56 | 26 | 0 | 18 | " |
| 27 | M + B | 20 | 59 | 0 | 0 | 0 | " |
| 28 | B + γ | 16 | 0 | 0 | 13 | 0 | " |

M: Martensite; AF: Acicular Ferrite; γ: Retained Austenite; B: Bainite; P: Pearlite

TABLE 3

| Steel No. | YS (MPa) | TS (MPa) | El (%) | TS × El (MPa · %) | Dynamic n-Value | Stretch Flanging Formability | WH + BH (MPa) | Remarks |
|---|---|---|---|---|---|---|---|---|
| 1 | 453 | 651 | 41 | 26691 | 0.42 | 55 | 134 | Examples of the Inventon |
| 2 | 446 | 643 | 41 | 26363 | 0.41 | 61 | 128 | " |
| 3 | 492 | 704 | 38 | 26752 | 0.37 | 61 | 137 | " |
| 4 | 483 | 624 | 41 | 25584 | 0.38 | 70 | 128 | " |
| 5 | 469 | 637 | 42 | 26754 | 0.39 | 52 | 125 | " |
| 6 | 467 | 647 | 39 | 25233 | 0.39 | 58 | 124 | " |
| 7 | 505 | 697 | 37 | 25789 | 0.36 | 50 | 121 | " |
| 8 | 482 | 678 | 39 | 26442 | 0.38 | 51 | 118 | " |
| 9 | 472 | 683 | 36 | 24588 | 0.39 | 58 | 116 | " |
| 10 | 494 | 695 | 35 | 24325 | 0.39 | 63 | 107 | " |
| 11 | 529 | 739 | 34 | 25126 | 0.40 | 53 | 105 | " |
| 12 | 506 | 704 | 35 | 24640 | 0.37 | 67 | 113 | " |
| 13 | 514 | 691 | 37 | 25567 | 0.37 | 63 | 115 | " |
| 14 | 497 | 718 | 35 | 15130 | 0.37 | 60 | 105 | " |
| 15 | 482 | 684 | 36 | 24624 | 0.37 | 52 | 119 | " |
| 16 | 467 | 674 | 37 | 24938 | 0.37 | 84 | 118 | " |
| 17 | 501 | 721 | 37 | 26677 | 0.37 | 80 | 122 | " |
| 18 | 456 | 637 | 28 | 17836 | 0.32 | 51 | 88 | Examples for Comparison |
| 19 | 472 | 669 | 31 | 20739 | 0.30 | 52 | 81 | " |
| 20 | 466 | 653 | 29 | 18937 | 0.32 | 55 | 89 | " |
| 21 | 435 | 624 | 30 | 18720 | 0.31 | 55 | 93 | " |
| 22 | 531 | 651 | 24 | 15624 | 0.25 | 60 | 86 | " |
| 23 | 527 | 721 | 25 | 18025 | 0.30 | 58 | 91 | " |
| 24 | 549 | 645 | 39 | 25155 | 0.24 | 60 | 75 | " |
| 25 | 462 | 693 | 32 | 22176 | 0.38 | 47 | 98 | " |
| 26 | 509 | 654 | 30 | 19620 | 0.32 | 54 | 96 | " |
| 27 | 518 | 679 | 30 | 20370 | 0.33 | 54 | 91 | |
| 28 | 523 | 668 | 39 | 26052 | 0.25 | 56 | 81 | |

What is claimed is:

1. A cold rolled steel sheet having high strength, high formability and excellent crushing performance, comprising:

ferrite as a major phase; and a minor phase consisting of martensite, acicular ferrite and retained austensite, wherein the ratio of the minor phase in the steel structure is 3–40%;

wherein the ratios of martensite, retained austenite and acicular ferrite in the minor phase are 10–80%, 8–30% and 5–60% respectively; and wherein the steel sheet comprises:

0.05–0.40 mass % of C,
1.0–3.0 mass % of Si,
0.6–3.0 mass % of Mn,
0.02–1.5 mass % of Cr,
0.010–0.20 mass % of P,
0.01–0.3 mass % of Al, and
the remainder consisting essentially of Fe.

2. The cold rolled steel sheet according to claim 1, wherein said steel sheet comprises at least one of 0.005–0.25 mass % of Ti and 0.003–0.1 mass % of Nb.

3. The cold rolled steel sheet according to claim 1, wherein said steel sheet comprises at least one of 0.1 mass % or less of Ca and 0.1 mass % or less of Rem.

4. The cold rolled steel sheet according to claim 1, wherein the cold rolled steel sheet (i) satisfies the equation: $TS \times El \geq 24{,}000$ MPa, where TS is the tensile strength and El is the elongation, and (ii) has a dynamic n-value of at least 0.35.

5. The cold rolled steel sheet according to claim 4, wherein the cold rolled steel sheet satisfies the equation: $WH+BH \geq 100$ MPa, where WH is the work hardening property and BH is the bake hardening property.

6. A method of making a cold rolled steel sheet having high strength, high formability and excellent crushing performance, the cold rolled steel sheet comprising 0.05–0.4 mass % of C, 1.0–3.0 mass % of Si, 0.6–3.0 mass % of Mn, 0.02–1.5 mass % of Cr, 0.010–0.20 mass % of P, 0.01–0.3 mass % of Al, and the remainder consisting essentially of Fe, the method comprising:

heating the cold rolled steel sheet by continuous annealing to a dual phase region of ferrite and austenite at a temperature of 740–820° C.;

retaining the cold rolled steel sheet at the temperature of 740–820° C., or gradually cooling the cold rolled steel sheet from the temperature of 740–820° C. at a cooling rate of not higher than 10° C./s;

then cooling the cold rolled steel sheet from a temperature of at least 600° C. to an acicular ferrite region at a temperature of 350–450° C. at a cooling rate of 20–60° C./s;

maintaining the cold rolled steel sheet in the acicular ferrite region at the temperature of 350–450° C., or cooling the cold rolled steel sheet gradually in the acicular ferrite region at the temperature of 350–450° C., for 0.5–5 min; and then cooling the cold rolled steel sheet to room temperature at a cooling rate of not higher than 50° C./s to form ferrite as a major phase and a minor phase consisting of acicular ferrite, martensite and retained austenite;

wherein the ratio of the minor phase in the steel structure is 3–40%; and wherein the ratios of martensite, retained austenite and acicular ferrite in the minor phase are 10–80%, 8–30% and 5–60%, respectively.

* * * * *